United States Patent [19]

Walter et al.

[11] Patent Number: 4,543,770

[45] Date of Patent: Oct. 1, 1985

[54] APPARATUS FOR PRODUCING AND CHARGING CONTAINERS IN A STERILE ATMOSPHERE

[76] Inventors: Kurt Walter, Königsberger Str. 8, D-6475 Glauburg 1; Wilfried Gokorsch, Hungener Str. 34, D-6303 Hungen 5; Günter Kurth, Hauptstr. 41, D-6479 Ranstadt 1; Rainer Grusdt, Karl Birx-Str. 33, D-6476 Hirzenhain 1; Manfred Schreiter, Vogelsbergstr. 22, D-6479 Ranstadt 1, all of Fed. Rep. of Germany

[21] Appl. No.: 470,785

[22] Filed: Mar. 1, 1983

[30] Foreign Application Priority Data

Mar. 2, 1982 [DE] Fed. Rep. of Germany ..... 3207426

[51] Int. Cl.[4] ..... B65B 31/00

[52] U.S. Cl. ..... 53/511; 53/167; 53/426; 53/559; 53/561; 53/563

[58] Field of Search ..... 53/453, 426, 433, 167, 53/511, 559, 561, 563; 422/26, 27; 264/525, 549

[56] References Cited

U.S. PATENT DOCUMENTS

| | | | |
|---|---|---|---|
| 2,736,150 | 2/1956 | Loew | 53/560 |
| 2,918,770 | 12/1959 | Stocker | 53/551 |
| 3,808,772 | 5/1974 | Turtschan | 53/559 |
| 3,911,640 | 10/1975 | Rausing | 53/167 |
| 3,972,153 | 8/1976 | Kiellarson et al. | 53/426 |
| 4,287,702 | 9/1981 | Cordic | 53/559 |
| 4,349,508 | 9/1982 | Liede | 53/426 |

*Primary Examiner*—John Sipos
*Assistant Examiner*—Donald R. Studebaker
*Attorney, Agent, or Firm*—Kurt Kelman

[57] ABSTRACT

Effective sterilization is obtained in an apparatus for producing a succession of containers from a length of foil, charging the containers and closing the charged containers in a sterile environment, where the deep-drawing station for forming the containers in the foil includes a vertically reciprocable lower portion defining a mold recess for receiving and forming respective containers in the foil and a stationary upper portion associated with the lower portion and defining a chamber in communication with the mold recess. The stationary upper portion of the deep-drawing station is heated, a supply conduit is connected to the upper portion for delivering a sterilizing fluid into the upper portion chamber under pressure, a discharge conduit is connected to the upper portion for exhausting the sterilizing fluid, a vertically reciprocable punch is mounted in the upper portion for reciprocation to the bottom region of the respective container, and a sterilizing fluid discharge channel passes through the punch and is in communication with the bottom region, the discharge channel being connected to the discharge conduit.

2 Claims, 5 Drawing Figures

11
10'
10
4
3
3'
24
1
3'
23
17
12
16
5
15
26
2
25
6
1'
27

34
11
13"
13'
34
14'
13
34
33
9
3'
12
1
14
3'
8
7
28
29
1"

14
9
1
14
8

2
20
21
19
22
12
1
18
27

APPARATUS FOR PRODUCING AND CHARGING CONTAINERS IN A STERILE ATMOSPHERE

This invention is concerned with an apparatus for for producing and charging containers in a sterile atmosphere.

It is known from U.S. Pat. No. 3,972,153 to manufacture cups to be shaped from a foil by means of vapor deformation, with the foil band running over a corresponding mold and being deformed by the vapor introduced from the top into the mold. This is done in a closed space equally filled with vapor, with the cup and covering foils being required to traverse special gates in order to be able to be introduced aseptically into the space and in order to maintain the space in closed condition. The gates are filled with a sterilizing fluid (e.g. peroxide), i.e. actual sterilization of the foils is performed in the gates by the fluid whereas the vapor atmosphere, basically, only serves to maintain the actual degree of sterilization. The apparatus required for that process is very costly and substantially differs from normal deep-drawing packaging machines.

Apart from health injury warnings that have been voiced—it is feared that peroxide might envolve carcinogenic effects—a complete removal of the peroxide will be required here which cannot always be fully assured.

In addition, the pertinent state of art is evinced by the following literature references: DE-OSs Nos. 28 39 543; 19 64 862; 29 19 015 and 16 67 936 US-PSs Nos. 2 918 770 and 2 736 150. On the assumption that, on the one hand, hot vapor by itself will be sufficient for a sterilization and, on the other hand, the use of sterilizing fluids should, if possible, be avoided for the afore-going reasons and, moreover, conventional deep-drawing machines containing all stations for deep-drawing, filling and closing, should be changed as little as possible, it had first to be expected that molding the cups by means of hot vapor according to the afore-mentioned US-PS No. 3 972 153 with no sterilizing foil introducing gates should be sufficient for a sterilization. However, quite unexpectedly, it proved that this was not the case, i.e. containers manufactured and filled in this manner, relative to the number of germs still existing, yielded unsatisfactory results.

Accordingly, it is an object of the invention—to provide an apparatus permitting full compliance with the following requirements:

Cup production and sterilization on the continuous foil with no risk of damage to the foil; sterilization in the form of a mix-free rinsing after deep-draw molding at the latest, by means of a sterile, pressurized medium to assure within a short period of time a complete or almost complete sterilization extending to all areas of the molded cup and, finally, assuring loading and closing of the vessels in sterile environments.

The above and other objects are accomplished according to the invention in an appatus for producing a succession of containers from a length of foil, charging the containers and closing the charged containers in a sterile environment, which comprises timed means for advancing the length of foil through successive stations for deep-drawing the pre-heated foil to form respective ones of the containers therein, each container defining a bottom region, charging the containers in succession, and closing the charged containers, and the deep-drawing station including a vertically reciprocable lower portion defining a mold recess for receiving and forming the respective container in the foil and a stationary upper portion associated with the lower portion, the improvement which comprises means for heating the stationary upper portion of the deep-drawing station, a supply conduit means connected to the upper portion for delivering a sterilizing fluid into the upper portion, a discharge conduit connected to the upper portion for exhausting the sterilizing fluid, a vertically reciprocable punch mounted in the upper portion for reciprocation to the bottom region of the respective container, and a sterilizing fluid discharge channel passing through the punch and being in communication with the bottom region, the discharge channel being connected to the discharge conduit.

Both plastic foils and metal foils (possibly also backed foils) are suitable for use as foil bands inasmuch as they can be deep-drawn and deformed by pressure application.

The vessels to be shaped into the foil in the form of cups can, of course, be provided in series in a single row or in side-by-side relatiosnhip in several rows.

The result attainable by the invention, and satisfactory as to the degree of sterilization, is due to the fact that, on account of the pointed flow guidance of the sterilizing medium, also the bottom area of the cup is also permanently rinsed, which will not be the case if the sterilizing medium is simply applied from the top within a forming die onto the foil to be deformed, as is done in the process according to US-PS No. 39 72 153.

As no flow takes place in this prior art process, the portion of the sterilizing medium contained in the bottom area, in all probability will more or less remain there so that surviving germs are left in that area of the molded cup.

Amazingly, this has been avoided thanks to the very simple process performed in the apparatus according to the invention.

The requirement "upon the final molding thereof at the very latest" conveys the following:

Depending on the properties of the foil, after a mechanical pre-stretching, the final molding can either be effected directly with the sterilizing medium, or the final molding can first be effected, e.g. by sterile air, and only then is the sterilizing medium introduced under pressure.

However, it is essential that the cup volume as formed be not simply filled with the sterilizing medium but that the discharge of the medium or media from the bottom area of the cup as formed take place centrally with the forming die still closed and that no mixing can take place between the medium already contained in the cup and the after-flowing medium.

The opening rim permanently opening and closing between the upper and lower portions of the actual deep-drawing die has proved to be the critical point, i.e. in that area it will still be possible for germs to settle, while these closing faces upon closure of the deep-drawing die would no longer be subject to vaporization or sterilization.

If preheating is now effected (it goes without saying that another preheating zone of prior known type can be provided) by means of a sterilizing medium, the foil will arrive already in sterilized form at the deep-drawing station with no need for it to be subjected inbetween to the atmosphere, i.e. also those areas will be sterilized that will be disposed between the closing faces of upper and lower portions.

The process can be substantially carried into effect with a largely conventional deep-drawing machine apart from the need to provide a sterile space behind the deep-drawing station for loading and closing the cups so as to permit a central discharge of the deforming and sterilizing media from the bottom area of the molded cup.

The pre-stretch punch for the foil deformation has been used with advantage for the formation of the discharge channel for the deforming and sterilizing media, respectively, which, depending on the performed pre-stretch movement, stops at the upper limit of the bottom area, with the outlet port to the discharge channel being cleared from the foil still covering the same, at the moment where the final shaping of the foil starts. The discharge channel will, of course, at a suitable point have to be provided with a choke or throttle-type valve in order to be able to attain the required final molding pressure for the foil.

Should this be a control valve, the same opens as soon as the final molding has been achieved.

When using a simple throttle-type valve, the supply amounts and pressures, respectively, will have to be so adjusted that the final molding will be attained.

The apparatus of the invention will now be explained in greater detail with reference to the illustration of preferred embodiments, wherein FIG. 1 is a side view of the overall apparatus;

Figures 1, 2, 3, 4:
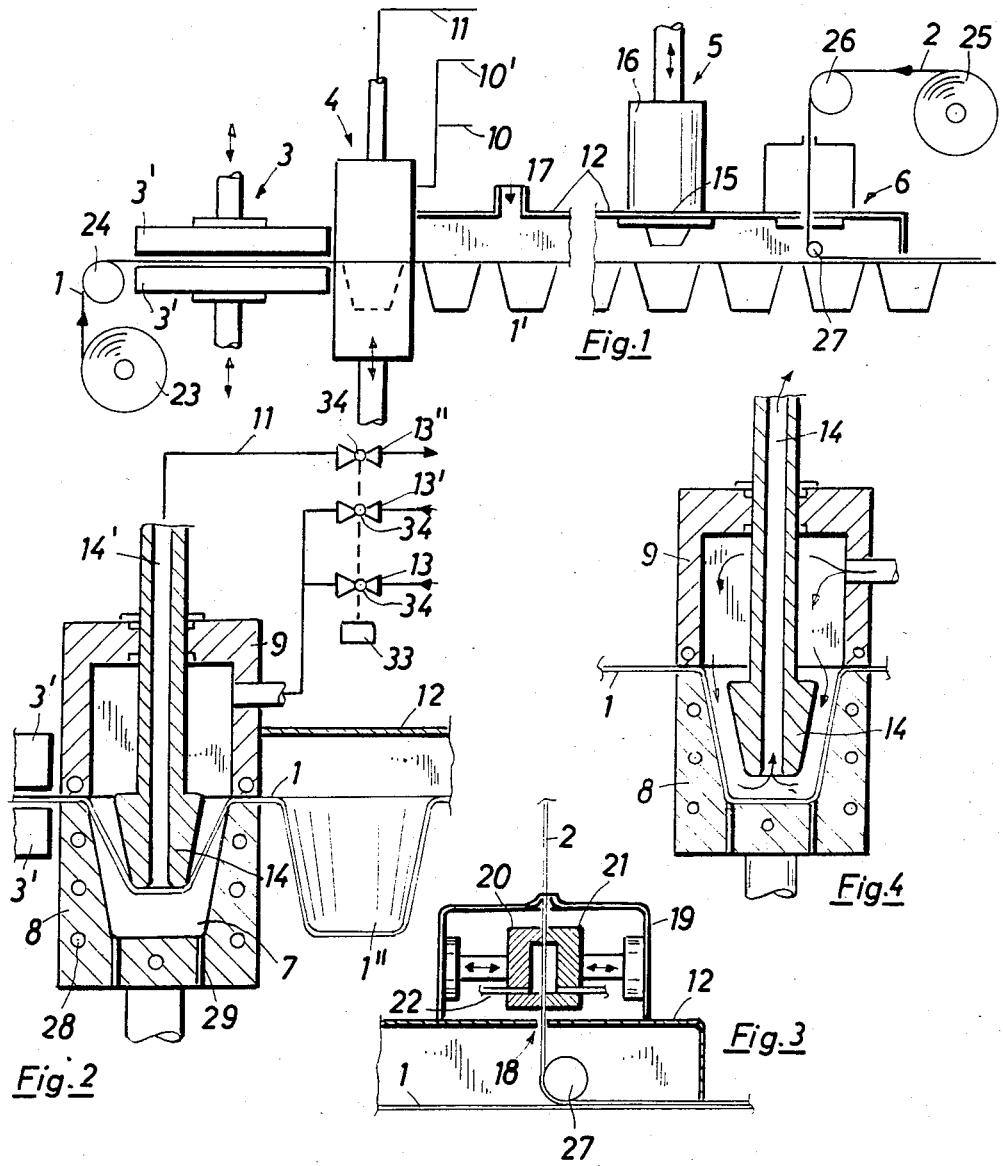
FIG. 2 is a sectional view of the deep-drawing station during the pre-stretching phase.
FIG. 3 is a sectional view of another part of the apparatus.
FIG. 4 is a sectional view of the deep-drawing station during the sterilizing phase.

As shown in FIG. 1, foil 1 runs from a supply roll 23 via an idler 24 first through preheating station 3 whose heating elements 3', are moved against each other and against the foil in timed sequence with the advancing foil.

In the deep-drawing station 4, foil 1 is molded into cups 1'. The foil provided with the cups 1' molded thereinto moves under the protection of a sterile tunnel 12 that is under a slightly superatmospheric pressure of sterile air supplied via sterile air inlet 17 under filling station 5 where cups 1' are charged by means of filling pump 16. Thereafter, the foil still under the protection of sterile tunnel 12 passes through closing station 6 where covering foil 2 is supplied from supply roll 25 via an idler 26, passing through a sterile medium rinsing chamber 19 (FIG. 3), and, with the aid of another idler 27, is applied and sealed in a sterile manner.

The elements for subsequently singling the charged and sealed cups 1' have not been shown. Equally, the illustration of the overall apparatus structure, of the conveying and lifting mechanism operating in timed sequence, the sterile medium conduits in their overall arrangement, the sterile vapor generator and the like details have been omitted. Deep-drawing station 4 comprises, as shown in FIGS. 2 and 4, a bottom portion 8 movable up and down and provided with temperature regulating channels 28 and blow-off channels 29 (for the air displaced during molding), with the bottom portion 8 having one or several mold depressions 7 and stationary upper portion 9 associated therewith.

Upper portion 9 in the shown example having a so-called prestretch punch 14, is provided with supply and discharge line connections 10,10', 11 for compressed air and/or vapor. All three connections 10,10', 11 include control valves 13,13', 13" that are operated by a common cam shaft 32 having a drive 33 and an operating cam 34.

The control can, of course, also be performed electrically by being correspondingly programmed.

Pre-stretch punch 14 provided with a discharge channel 14' during the pre-stretch phase will approximately occupy the position according to FIG. 2, with the heated foil 1 being entrained under stretch, the marginal areas bring held between upper and lower portions 9,8, as shown. At that moment, the sterile and possibly preheated compressed air or the sterilizing medium (hot vapor) is supplied directly through the supply line connection 10 and 10', respectively, with the prestretched foil being deep-drawn against the wall of depression 7 of bottom portion 8, while valves 13 and 13" remain closed.

Immediately upon completion of the deep-drawing operation, valve 13 is closed and valves 13', 13" are opened, with opening of valve 13" possibly being slightly delayed.

As diclosed by FIG. 4, in the deep-drawing die, a forceguided flow occurs in the sense of the arrows, i.e. the sterilizing medium flows into upper portion 9, inevitably traversing the annular gap between pre-stretching punch 14 and the inner cup wall in the downward direction thus being passed into the bottom area 1" of cup 1' which it can leave only through discharge channel 14' of pre-stretching punch 14, i.e. the entire bottom area is intensively rinsed. This is, as mentioned before, of decisive importance for the success of an optimum sterilization. Owing to that forced guidance of the sterilizing medium, mixing of incoming and outgoing media will be safely prevented from occurring.

Finally molded cup 1' sterilized directly after moulding, by downward withdrawal of bottom portion 8, is free to be advanced with the entire foil 1 by a cup width. Finished cups 1' at least on the sides of the inner faces remain in a sterile atmosphere since, as especially shown in FIG. 1, they are protected by sterile tunnel 12 directly connected to the upper portion and provided with sterile air inlet 17, with the sterile tunnel being maintained at a slightly superatmospheric pressure to prevent access of germs from the atmosphere from occurring.

As filling station 5 with filling pump 16 and its outlet 15 is integrated into the sterile tunnel 12 (a sterile pump of conventional construction is used as the filling pump), the product is charged into sterile cups 1' in a sterile manner. Located behind the filling station 5 is closing station 6 that, as shown by FIG. 3, is comprised of a sterile medium rinsing chamber 19 from which emerges the covering foil 2 rendered aseptic by this medium, passing through the covering foil inlet 18 to reach sterile tunnel 12 and to be sealed in a known manner onto foil 1 provided with the filled cups 1'.

Advantageously, two cup-shaped chamber portions 20,21 movable against covering foil 2 are disposed in chamber 19, with at least chamber portion 20 located on the product side being provided with a supply line 22 for the sterilizing medium.

Temperature-regulation of the compressed air, if used, and pressure and temperature adjustment of the vapor are so performed that a sterilization temperature of at least 150° C. is produced.

Even if no a pre-stretching is required, the pre-stretching punch 14 with its discharge channel 14' will have to be retained in order to maintain the discharge function from the bottom area 1'' of the cup, in which case the pre-stretching punch has the function of an immersion probe that during or immediately after completion of the final molding is introduced into cup 1' down to the bottom area.

The punch 14 must, of course, be sealed in the top wall of upper portion 9.

Figure 5:
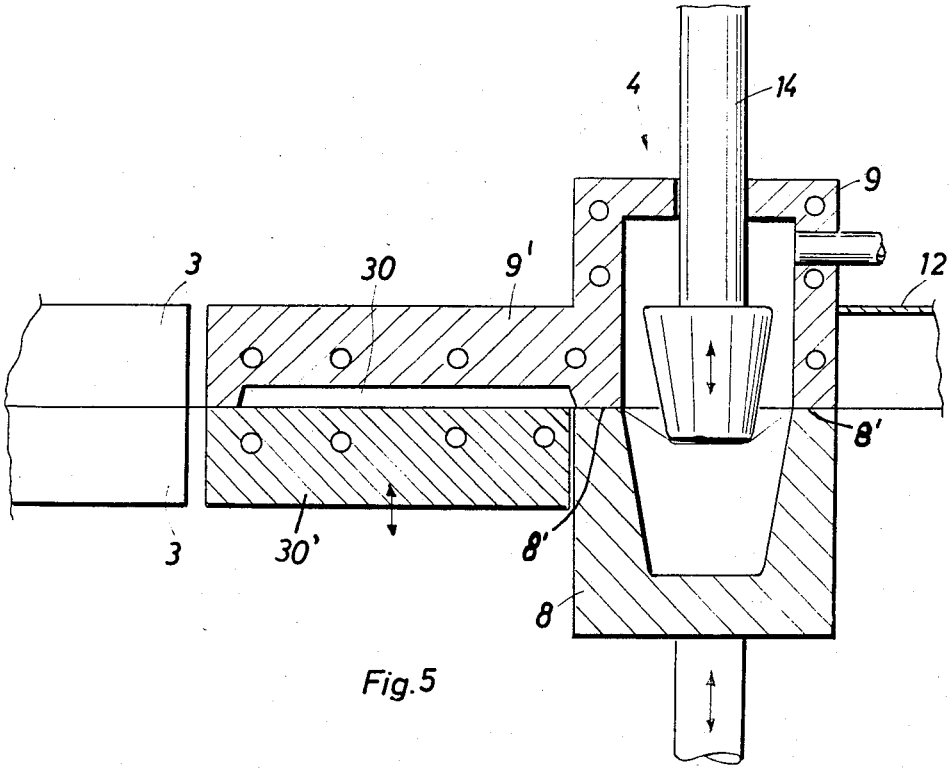
FIG. 5 is a sectional view of a preferred form of embodiment of the foil preheating area of the apparatus.

As mentioned previously, presterilization of the foil immediately prior to the run into the deep-drawing station 4 is preferred. According to FIG. 5, the deep-drawing station 4 for this purpose, has a special construction. Upper portion 9 at the inlet side thereof is provided with a preheating head 9' including recessed chamber 30. Bottom portion 30', equally heated, includes either—as shown—a flat mounting face or also defines a recessed chamber. Since bottom portion 8 of the deep-drawing station is cooled, the two bottom portions 8,30 are maintained in spaced-apart relationship. The length of the recessed chamber is so dimensioned that the parts of foil 1 passed between the closing faces 8' are covered during pre-sterilization.

We claim:

1. In an apparatus for producing a succession of containers from a length of foil, charging the containers and closing the charged containers in a sterile environment, which comprises timed means for advancing the length of foil through successive stations for deep-drawing the pre-heated foil to form respective ones of the containers therein, each container defining a bottom region, charging the containers in succession, and closing the charged containers, and the deep-drawing station including a vertically reciprocable lower portion defining a mold recess for receiving and forming the respective container in the foil and a stationary upper portion associated with the lower portion and defining a chamber in communication with the mold recess, the improvement which comprises (a) means for heating the stationary upper portion of the deep-drawing station, (b) a supply conduit means connected to the upper portion for delivering a sterilizing fluid into the upper portion chamber under pressure, (c) a discharge conduit connected to the upper portion for exhausting the sterilizing fluid, (d) a vertically reciprocable punch mounted in the upper portion for reciprocation to the bottom region of the respective container and being smaller in size than said lower portion to allow said sterilizing fluid to flow to the bottom region of said container, and (e) a sterilizing fluid discharge channel passing through the punch and being in communication with the bottom region, the discharge channel being connected to the discharge conduit.

2. In the apparatus of claim 1, a foil pre-heating head arranged upstream of the deep-drawing station in the direction of advance of the length of foil, the pre-heating head comprising a recessed chamber receiving a sterilizing fluid and a heatable support portion for the length of foil, the heatable foil support portion being spaced from the lower portion of the deep-drawing station.

* * * * *